US006092444A

United States Patent [19]

Hsiao

[11] Patent Number: 6,092,444

[45] Date of Patent: Jul. 25, 2000

[54] FOLDING COMBINATION TOOL KIT

[76] Inventor: Chia-Yuan Hsiao, No. 4, Lane 11, Tze-Chiang St., Tu-Cheng City, Taipei Hsien, Taiwan

[21] Appl. No.: 09/249,802

[22] Filed: Feb. 16, 1999

[51] Int. Cl.[7] ..... B25B 23/00

[52] U.S. Cl. ..... 81/440; 81/124.5; 7/168

[58] Field of Search ..... 81/440, 437, 124.5; 7/100, 118, 138, 151, 165, 168

[56] References Cited

U.S. PATENT DOCUMENTS 5,320,004 6/1994 Hsiao ..... 81/440

FOREIGN PATENT DOCUMENTS 0525 527 9/1921 France ..... 81/124.5

*Primary Examiner*—James G. Smith
*Assistant Examiner*—Hadi Shakeri
*Attorney, Agent, or Firm*—Rosenberg, Klein & Lee

[57] ABSTRACT

A folding combination tool kit includes two oblong friction plates connected in parallel by bolts and nuts to hold a set of tools, enabling the tools to be respectively turned about the bolts in and out of the space defined between the oblong friction plates, wherein a flat connector is pivoted to one of the bolts, and an auxiliary tool is detachably coupled to the flat connector, the flat connector having a pivot hole, which receives one bolt, two shoulders bilaterally disposed at one end, and a flat, stepped, coupling portion at an opposite end for holding the auxiliary tool, the auxiliary tool having a first end, which is stopped at the shoulders of the flat connector when the auxiliary tool is coupled to the flat connector, a coupling notch longitudinally disposed on the first end and forced into engagement with the coupling portion of the flat connector, a second end, and a locating notch at one lateral side thereof between the first end and the second end for engagement with the locating rod when the auxiliary tool is turned with the flat connector into the inside of the receiving space between the oblong friction plate. The auxiliary tool can be a spanner for adjusting the screw and nut of a bicycle brake, a spanner for adjusting the cap nut at one spoke of a bicycle tire, or a bottle cap opener.

6 Claims, 8 Drawing Sheets

FOLDING COMBINATION TOOL KIT

BACKGROUND OF THE INVENTION

The present invention relates to tool kits, and more particularly to a folding combination tool kit which has detachable auxiliary tool means for use to adjust the screw and nut of a bicycle brake and the spokes of a bicycle wheel.

A variety of tools and bits are designed for different purposes. A work man may have to prepare a variety of tools and bits for different working requirements. It is inconvenient to carry a variety of tools and bits. There is known a folding combination tool kit 4 which holds a plurality of tools 41 (see FIG. 1). Because the tools 41 are not detachable, an additional spanner 3 must be used when adjusting the screw 21 and nut 22 of a bicycle brake 2.

SUMMARY OF THE INVENTION

It is the main object of the present invention to provide a folding combination tool kit which has detachable auxiliary tool means for use to adjust the screw and nut of a bicycle brake and the spokes of a bicycle wheel. According to one aspect of the present invention, the folding combination tool kit comprises two oblong friction plates connected in parallel by bolts and nuts to hold a set of tools, enabling the tools to be respectively turned about the bolts in and out of the space defined between the oblong friction plates, wherein a flat connector is pivoted to one of the bolts, and an auxiliary tool is detachably coupled to the flat connector, the flat connector having a pivot hole, which receives one bolt, two shoulders bilaterally disposed at one end, and a flat, stepped, coupling portion at an opposite end for holding the auxiliary tool, the auxiliary tool having a first end, which is stopped at the shoulders of the flat connector when the auxiliary tool is coupled to the flat connector, a coupling notch longitudinally disposed on the first end and forced into engagement with the coupling portion of the flat connector, a second end, and a locating notch at one lateral side thereof between the first end and the second end for engagement with the locating rod when the auxiliary tool is turned with the flat connector into the inside of the receiving space between the oblong friction plate. According to another aspect of the present invention, the auxiliary tool can be a spanner for adjusting the screw and nut of a bicycle brake, a spanner for adjusting the cap nut at one spoke of a bicycle tire, or a bottle cap opener.

DETAILED DESCRIPTION OF THE PREFERRED EMBODIMENT

Figure 4:
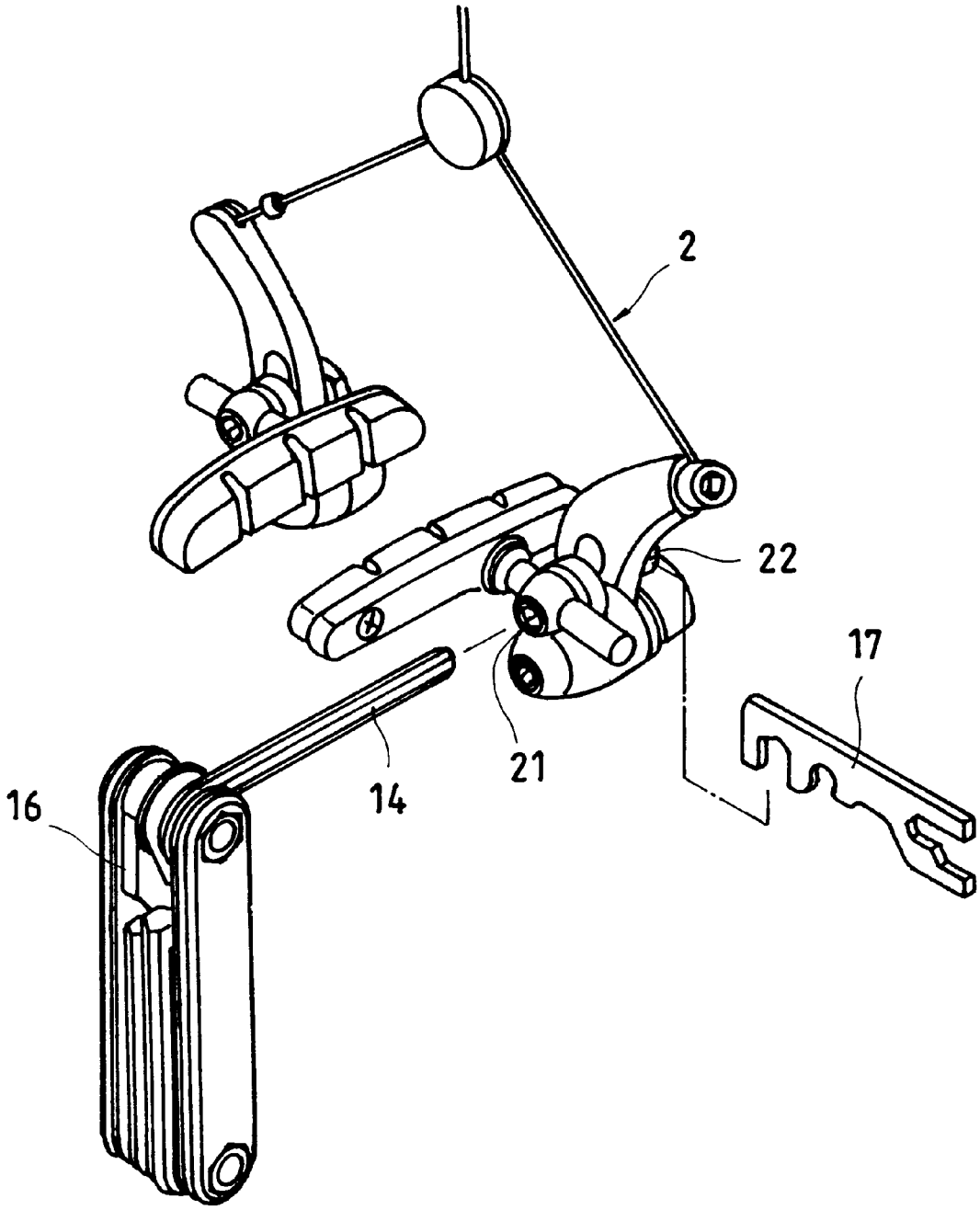
FIG. 4 shows the application example of the present invention for adjustment of the screw and nut of a bicycle brake.

Referring to Figures from 1 through 4, two oblong friction plates 1 are connected in parallel by two bolts 12. Two transparent face plates 11 are fastened to the bolts 12, and respectively attached to the oblong plates 1 at an outer side. A set of hex wrenches 14 and a set of screwdrivers 13 are respectively coupled to the bolts 12 between the oblong friction plates 1. The hex wrenches 14 and the screwdrivers 13 can be respectively tuned about the respective bolts 12 between a first position in the receiving space defined between the oblong friction plates 11, and a second position out of the receiving space. A locating rod 174 is connected between the oblong friction plates 1 on the middle, and spaced between the bolts 12 for resting of the free ends of the tools 13 and 14. A spacer 15 is mounted on the bolts 12, and retained between the tools 13 and 14 and one oblong friction plate 1. A metal saw 151 and a pin 152 are respectively turned about the bolts 12, and retained between the spacer 15 and the adjacent oblong friction plate 1. The metal saw 151 can be used to file a tire patch. The pin 152 can be inserted into the air valve of a bicycle tire to release air. A flat connector 16 of certain thickness is turned about one bolt 12. The flat connector 16 comprises a pivot hole 1621 on the middle, which receives one bolt 12, two shoulders 161 bilaterally disposed at one end, and a coupling portion 162 at an opposite end. A spanner 17 is coupled to the flat connector 16. The spanner 17 comprises a coupling notch 171 at one end coupled to the coupling portion 162 of the flat connector 16, a locating notch 172 at one lateral side for engagement with the locating rod 174, and a working notch 173 at an opposite end for turning a bolt. When the coupling notch 171 of the spanner 17 is forced into engagement with the coupling portion 162 of the flat connector 16, one end of the spanner 17 is stopped at the shoulders 161. When the spanner 17 is turned with the flat connector 16 about the respective bolt 12 in the receiving space between the oblong friction plates 1, a recessed portion 1721 in the locating notch 172 is forced into engagement with the locating rod 174, enabling the spanner 17 to be secured to the inside of the folding combination tool kit within the receiving space between the oblong friction plates 1. The spanner 17 can be used with the hex wrenches 14 to adjust the screw 21 and nut 22 of a bicycle brake 2 (see FIG. 4). Further, the coupling portion 162 of the flat connector 16 may be variously shaped. According to the present embodiment, the coupling portion 162 of the flat connector 16 has a flat, stepped shape with a pointed front end. The coupling notch 171 of the spanner 17 fits the profile of the coupling portion 162.

Figure 1:
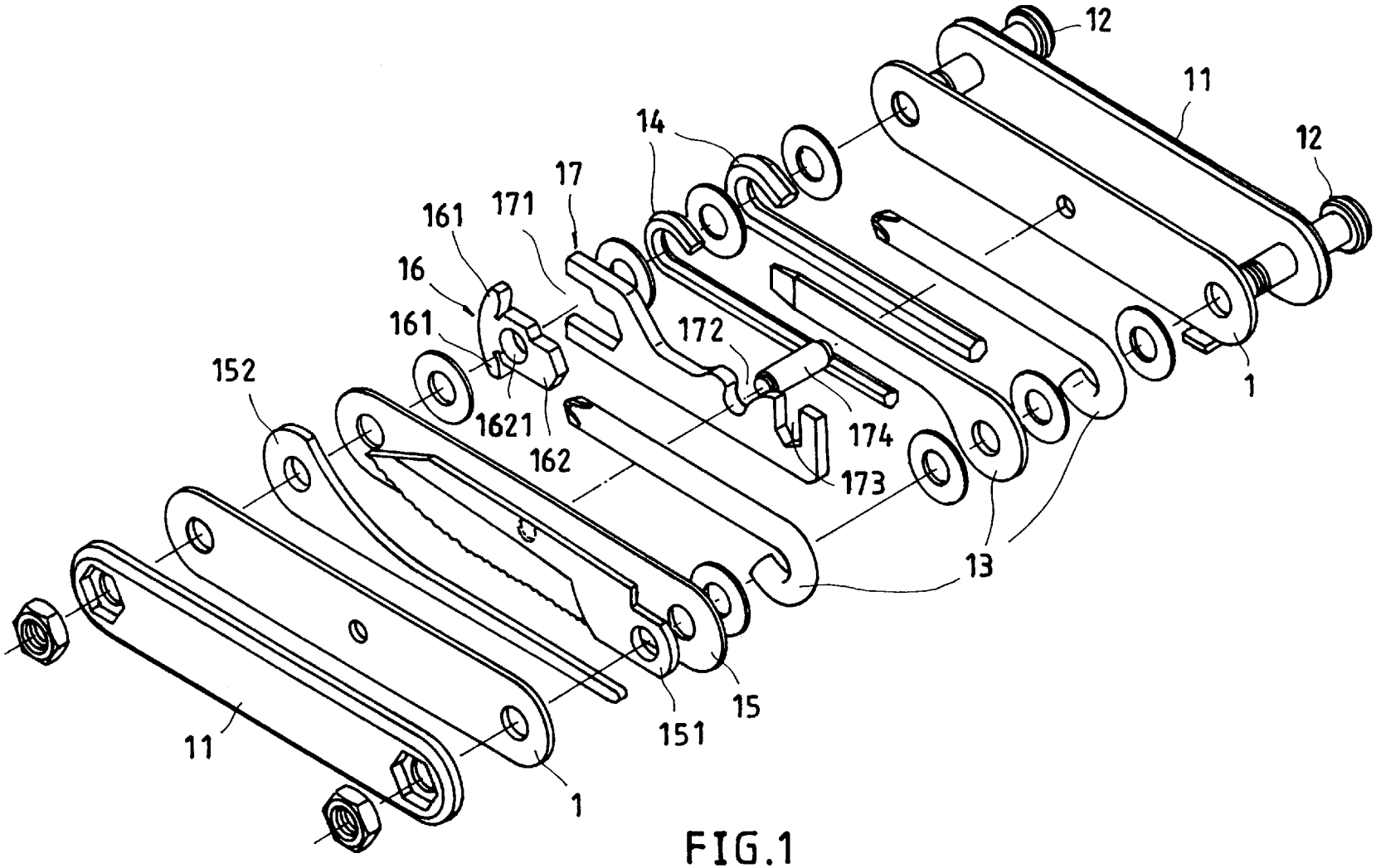
FIG. 1 is an exploded view of a folding combination tool kit according to one embodiment of the present invention.
Figure 3:
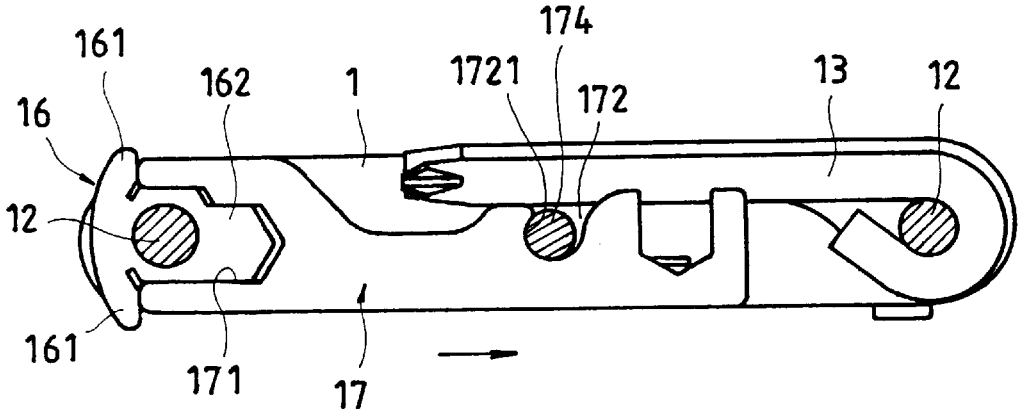
FIG. 3 is similar to FIG. 2 but showing the spanner retained to the locating rod in the folding combination tool kit.
Figure 2:
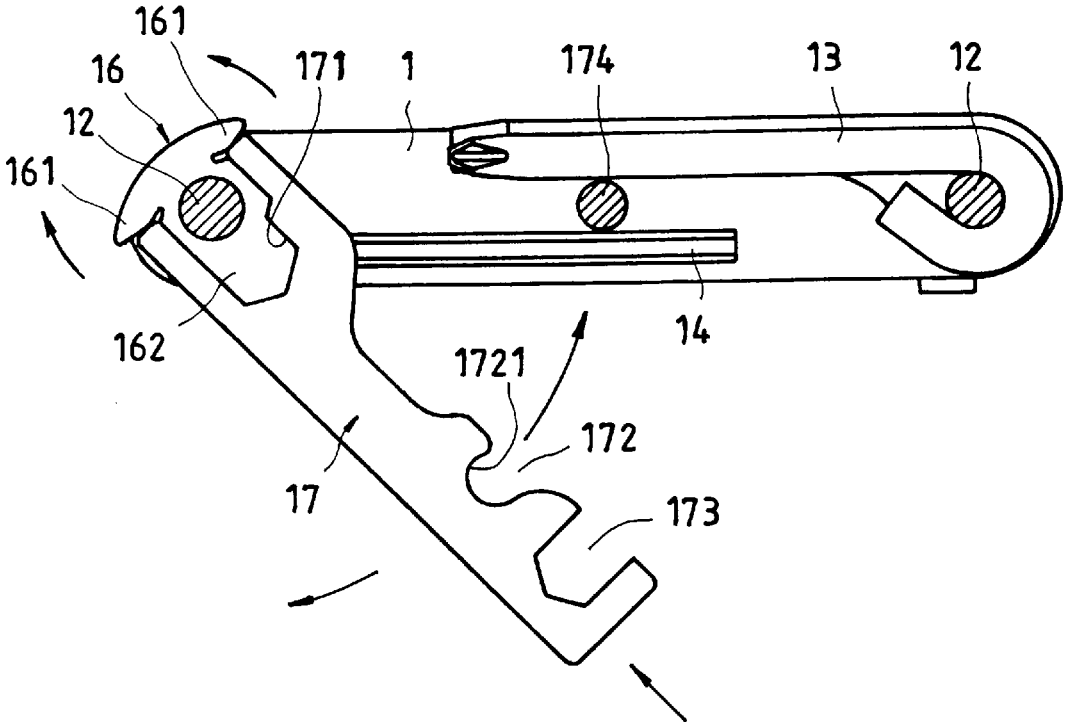
FIG. 2 shows a spanner coupled to a flat connector at one bolt in the folding combination tool kit according to the present invention.
Figure 5:
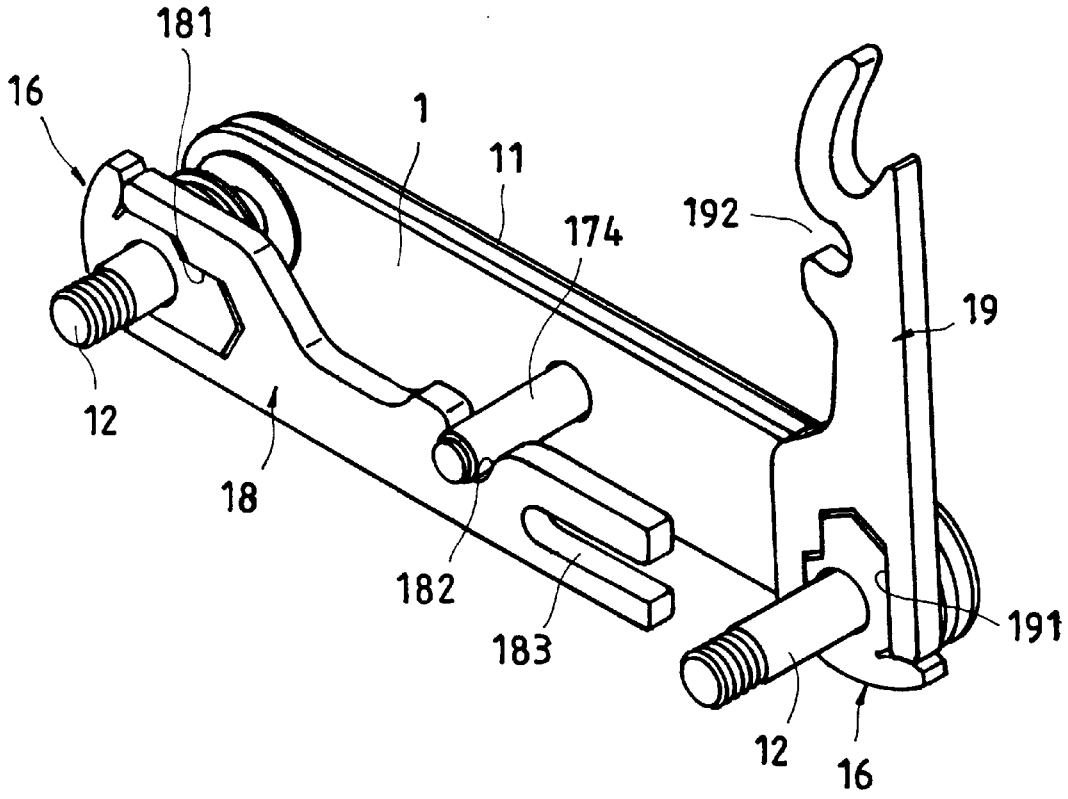
FIG. 5 shows two flat connectors respectively pivoted to the bolts in the folding combination tool kit, a spoke adjustment spanner and a bottle cap opener respectively coupled to the flat connectors.
Figure 6:
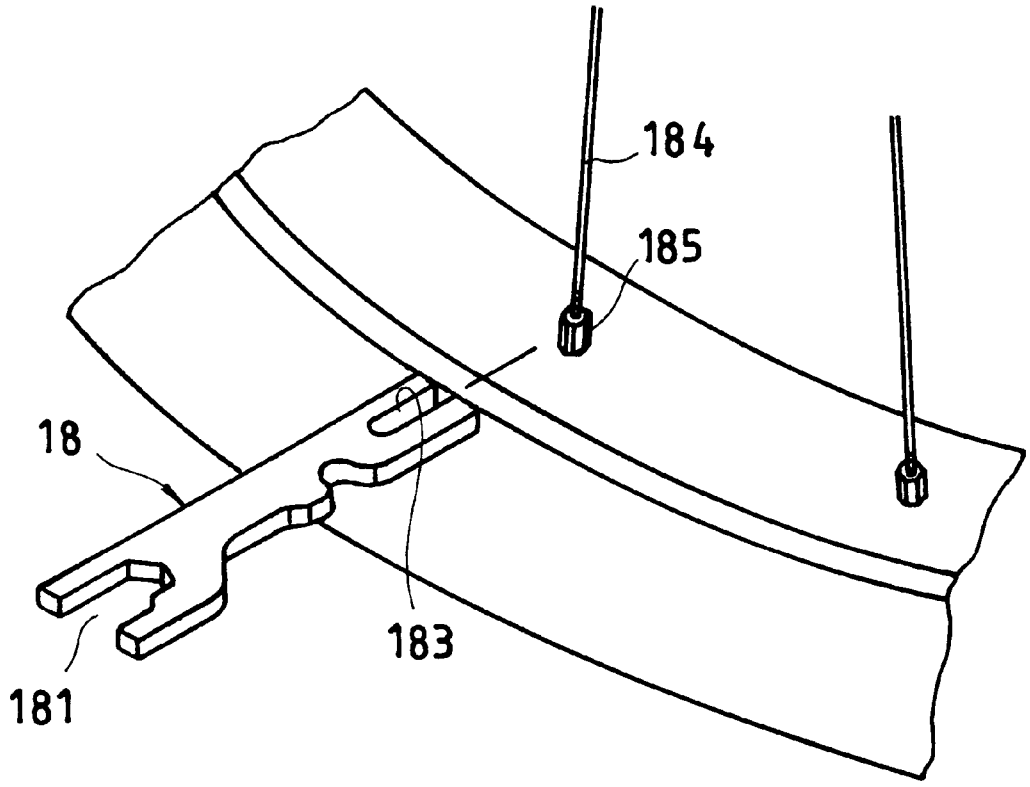
FIG. 6 illustrates an application example of the spoke adjustment spanner according to the present invention.

Referring to FIGS. 5 and 6, two flat connectors 16 are respectively pivoted to the bolts 12 to hold a spoke adjustment spanner 18 and a bottle cap opener 19. The spoke adjustment spanner 18 comprises a coupling notch 181 at one end for engagement with the coupling portion 162 of the flat connector 16 (see also FIG. 1), a locating notch 182 at one lateral side for engagement with the locating rod 174, and a working notch 183 at an opposite end for turning the adjustment cap nut 185 at one spoke 184 of a bicycle wheel (see FIG. 6).

Figure 7:
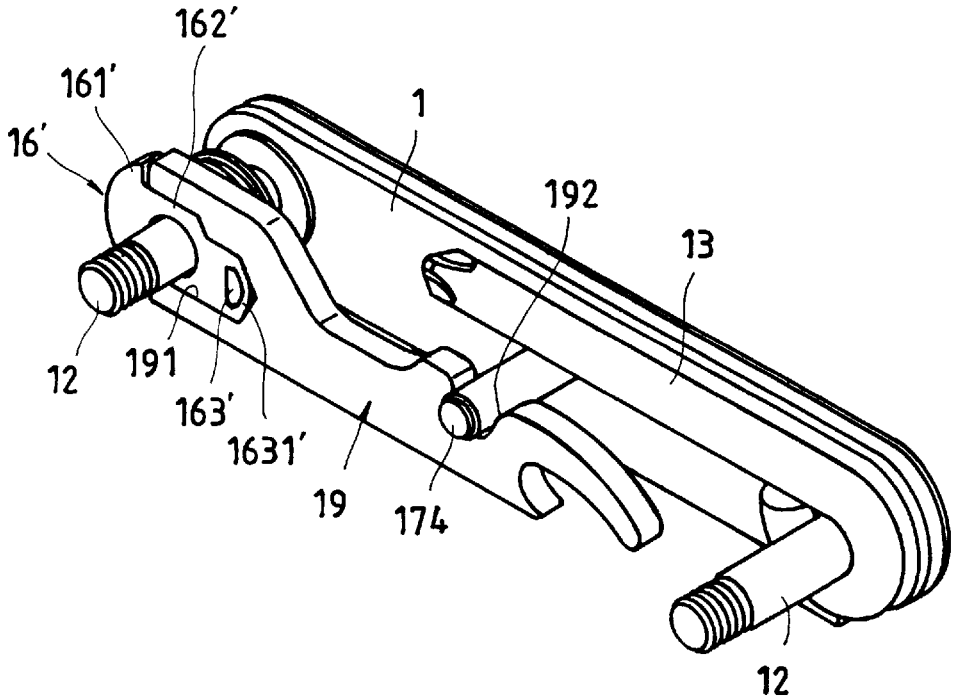
FIG. 7 shows an alternate form of the flat connector, and a bottle cap opener coupled to the flat connector and retained to the locating rod in the folding combination tool kit according to the present invention.
Figure 8:
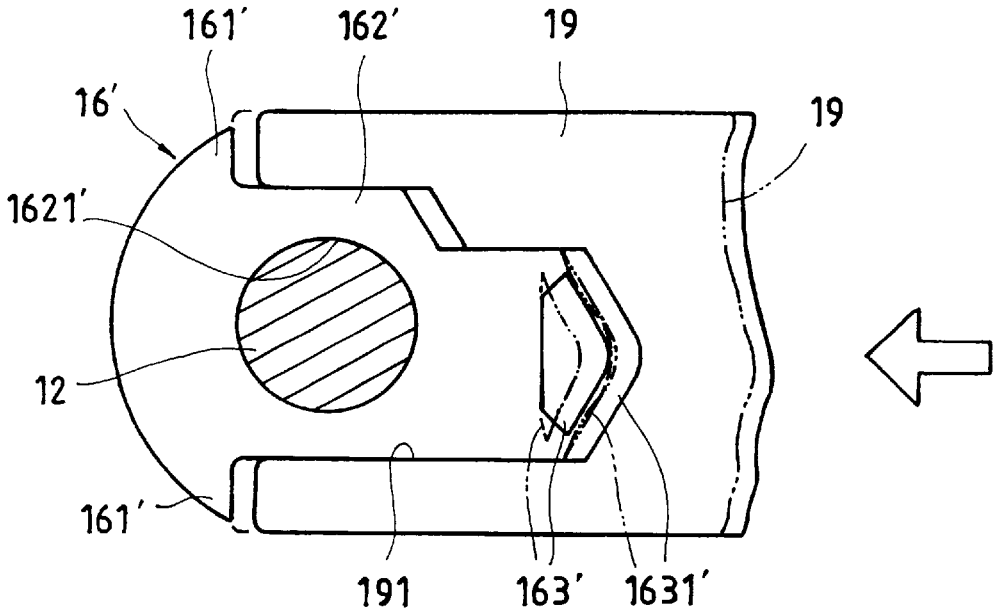
FIG. 8 illustrates the front end of the flat connector of the alternate form of FIG. 7 compressed upon installation of the bottle cap opener according to the present invention.

Referring to FIGS. 7 and 8, the flat connector 16' comprises a pivot hole 1621', which receives one bolt 12, two shoulders 161' bilaterally disposed at one end, a coupling portion 162' at an opposite end, an opening 163' at the coupling portion 162' adjacent the pointed front end 1631' of the coupling portion 162'. The bottle cap opener 19 comprises a coupling notch 191 at one end forced into engagement with the coupling portion 162', a locating notch 192 at one lateral side for engagement with the locating rod 174. The opening 163' makes the pointed front end 1631' compressible. When the coupling notch 191 of the bottle cap opener 19 is coupled to the coupling portion 162' of the flat connector 16', the pointed front end 1631' is compressed, enabling the bottle cap opener 19 to be firmly secured to the flat connector 16' (see FIG. 8).

Figure 9:
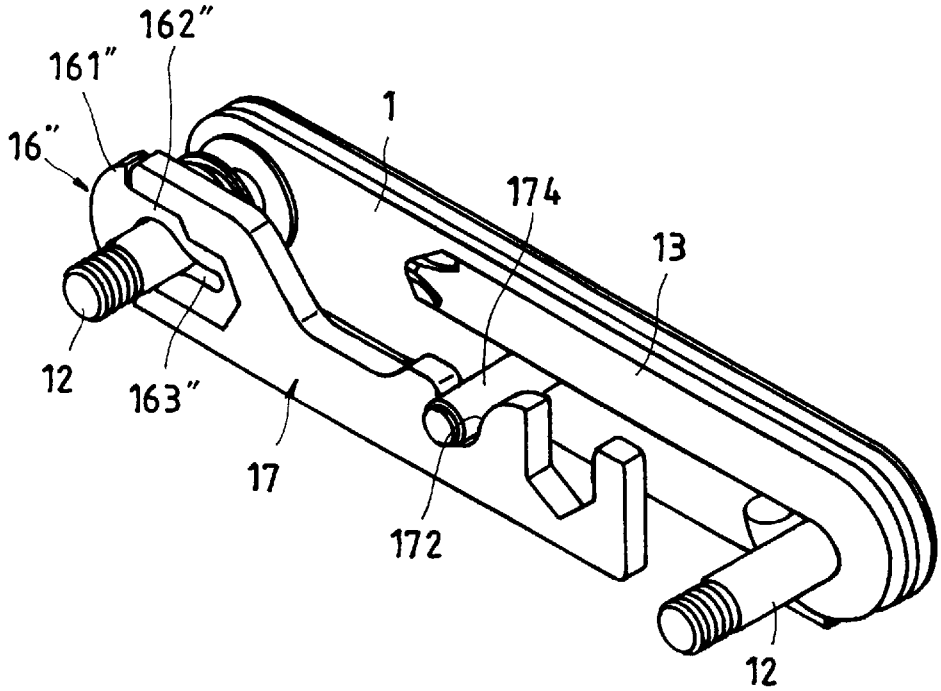
FIG. 9 shows another alternate form of the flat connector, and a spanner coupled to the flat connector and retained to the locating rod in the folding combination tool kit according to the present invention.
Figure 10:
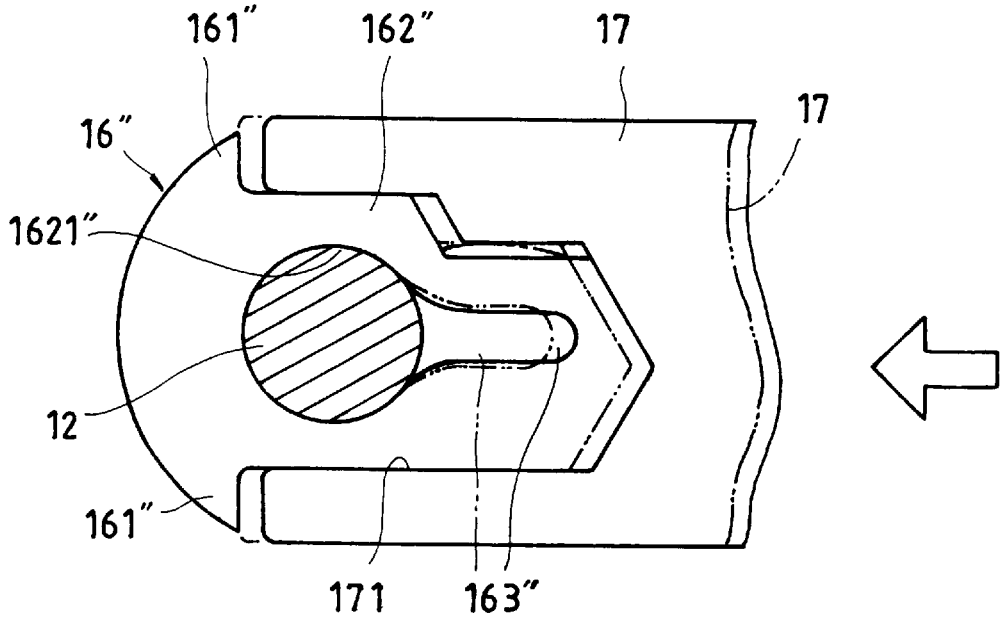
FIG. 10 illustrates the front end of the flat connector of the alternate form of FIG. 9 compressed upon installation of the spanner.
Figure 11:
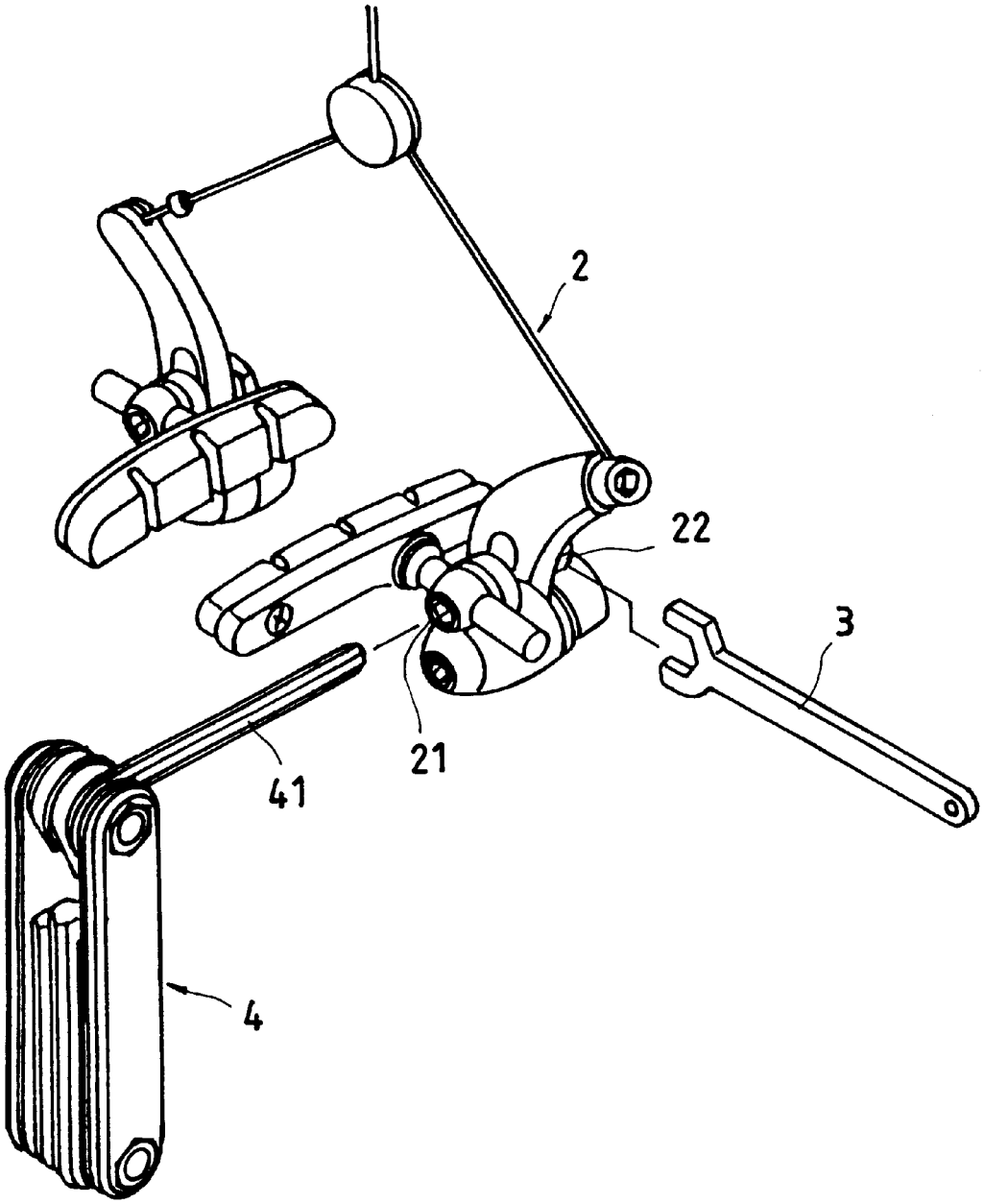
FIG.11 PRIOR ART
FIG. 11 illustrates a prior art folding combination tool kit and an open end wrench used for adjustment of the screw and nut of a bicycle brake.

Referring to FIGS. 9 and 10, the flat connector 16" comprises a pivot hole 1621", which receives one bolt 12, two shoulders 161" bilaterally disposed at one end, a coupling portion 162" at an opposite end, and an oblong slot 163" longitudinally forwardly extended from the pivot hole 1621" on the middle of the coupling portion 162". The oblong slot 163" makes the front end of the coupling portion 162" compressible. When the coupling notch 171 of the spanner 17 is coupled to the coupling portion 162" of the flat connector 16', the front end of the coupling portion 162" is compressed, enabling the spanner 17 to be firmly secured to the flat connector 16" (see FIG. 10).

It is to be understood that the drawings are designed for purposes of illustration only, and are not intended as a definition of the limits and scope of the invention disclosed.

What the invention claimed is:

1. A folding combination tool kit comprising two oblong friction plates connected in parallel, said oblong friction plates defining a receiving space, two bolts connected in parallel between said oblong friction plates, two face plates mounted on said bolts and respectively attached to said oblong friction plates at an outer side, a set of tools respectively turned in and out of said receiving space about said bolts between said oblong friction plates, and a locating rod connected between said oblong friction plates on the middle and spaced between said bolts for the resting of free ends of said tools;

wherein a flat connector is pivoted to one of said bolts, and an auxiliary tool is detachably coupled to said flat connector, said flat connector comprising a pivot hole, which receives one bolt, two shoulders bilaterally disposed at one end, and a flat, stepped, coupling portion at an opposite end for holding said auxiliary tool, said auxiliary tool comprising a first end, which is stopped at the shoulders of said flat connector when said auxiliary tool is coupled to said flat connector, a coupling notch longitudinally disposed on said first end and forced into engagement with the coupling portion of said flat connector, a second end, and a locating notch at one lateral side thereof between said first end and said second end for engagement with said locating rod when said auxiliary tool is turned with said flat connector into the inside of said receiving space.

2. The folding combination tool kit of claim 1 wherein said flat connector has an opening near.

3. The folding combination tool kit of claim 1 wherein said flat connector has an oblong slot longitudinally forwardly extended from its pivot hole on the middle of said coupling portion.

4. The folding combination tool kit of claim 1 wherein said auxiliary tool has a working notch near its second end for adjusting the screw and nut of a bicycle brake.

5. The folding combination tool kit of claim 1 wherein said auxiliary tool has a working notch at its second end for adjusting the cap nut at one spoke of a bicycle tire.

6. The folding combination tool kit of claim 1 wherein said auxiliary tool has a bottle cap opener formed integral with its second end.

* * * * *